US005522406A

United States Patent [19]

Yang

[11] Patent Number: 5,522,406

[45] Date of Patent: Jun. 4, 1996

[54] ASH TRAY EQUIPPED WITH DISPOSABLE ASH POCKET

[76] Inventor: Dong B. Yang, Hyundae Apt. 104-101, Seonhwa-dong 151-1, Jung-ku, Daejeon, Rep. of Korea

[21] Appl. No.: 337,501

[22] Filed: Nov. 8, 1994

[30] Foreign Application Priority Data

Dec. 9, 1993 [KR] Rep. of Korea ..... 1993-26912

[51] Int. Cl.[6] ..... A24F 19/00

[52] U.S. Cl. ..... 131/231; 131/238; 131/241

[58] Field of Search ..... 131/231, 235.1, 131/256, 237

[56] References Cited

U.S. PATENT DOCUMENTS 2,938,522 5/1995 Hastings ..... 131/239

4,911,180 3/1990 Ogasahara ..... 131/235.1

*Primary Examiner*—Vincent Millin

*Assistant Examiner*—Charles W. Anderson

[57] ABSTRACT

An ash tray for eliminating the troublesome and insanitary work necessary to replace and clean it. The ash tray includes an ash box, a plurality of disposable ash pockets received in the ash box which are stacked one in another and means for extinguishing a cigarette which is disposed at a corner of the plurality of ash pockets. The extinguishing means may be integrally formed with or separated from the ash pocket.

5 Claims, 2 Drawing Sheets

ASH TRAY EQUIPPED WITH DISPOSABLE ASH POCKET

BACKGROUND OF THE INVENTION

1. Field of the Invention

The present invention relates to an ash tray, and more particularly to an ash tray equipped with a plurality of disposable ash pockets having extinguisher.

2. Description of the Prior Art

In general, a home or a shop is provided with ash trays which are made of glass material or heat-resisting plastic material for the convenience of smokers. When the ash tray is filled with cigarette ashes and cigarette-butts, the ash tray should be cleaned out. In case of a shop such as a coffee shop, a used ash tray filled with ashes and cigarette-butts should be replaced with a cleaned ash tray whenever a customer is changed. Furthermore, the used ash tray should be cleaned to be reusable.

However, the work that every ash tray made of glass or heat-resisting plastic material should be replaced and cleaned whenever a customer is changed is troublesome and insanitary. In addition, since a smoker usually extinguishes cigarette by rubbing a light portion of the cigarette against an ash tray, the light of the cigarette may not be completely extinguished but remain for a long time, thereby causing smoke to rise from the cigarette for a long time.

SUMMARY OF THE INVENTION

The present invention has been made in view of the above-described problems occurring in the above-mentioned ash tray and an object of the invention is to provide an ash tray for eliminating the troublesome and insanitary work that it should be replaced and cleaned whenever a customer is changed.

In accordance with the present invention, the object of the invention can be accomplished by providing an ash tray comprising: an ash box; a plurality of disposable ash pockets inserted in the ash box which are stacked one in another; and means for extinguishing light of a cigarette which is disposed at a corner of the plurality of ash pockets.

The extinguishing means may be a conical extinguisher integrally formed with the ash pocket or a separable conical extinguisher.

BRIEF DESCRIPTION OF THE DRAWINGS

These and other objects and aspects of the invention will become apparent from the following description of an embodiment with reference to the accompanying drawings in which.

DETAILED DESCRIPTION OF THE PREFERRED EMBODIMENTS

Embodiments according to an ash tray of the present invention will be described with reference to the accompanying drawings hereinafter.

Figure 1:
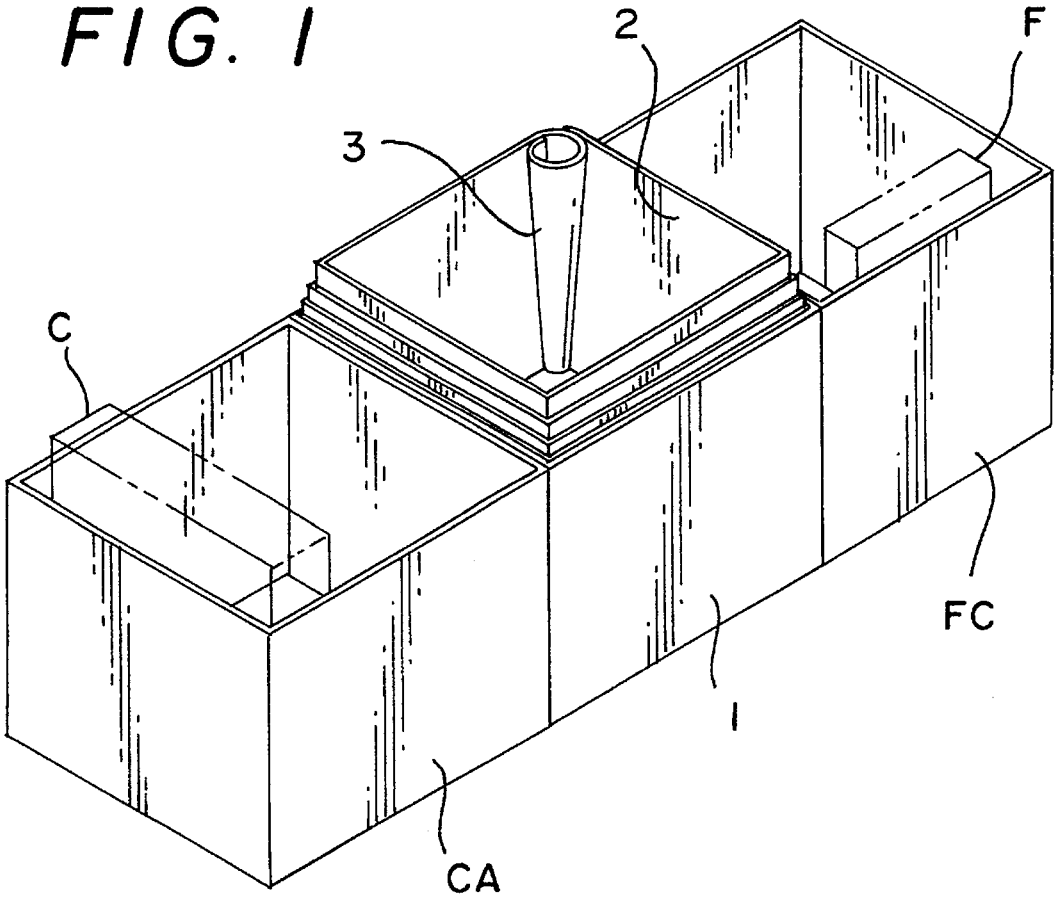
FIG. 1 is a perspective view showing an ash tray according to the present invention.

Referring to FIG. 1, there is shown an ash tray according to the invention. As shown in the drawing, the ash tray of the invention includes a cigarette box "CA" for receiving cigarette cases "C", a match box "FC" for receiving matches "F" and an ash box 1 disposed between the cigarette box "CA" and the match box "FC". The ash box 1 is provided therein with a plurality of disposable ash pockets 2 each having an extinguishing means at a corner. The plurality of disposable ash pockets 2 made of heat-resisting sheets are stacked one in another.

Figure 2:
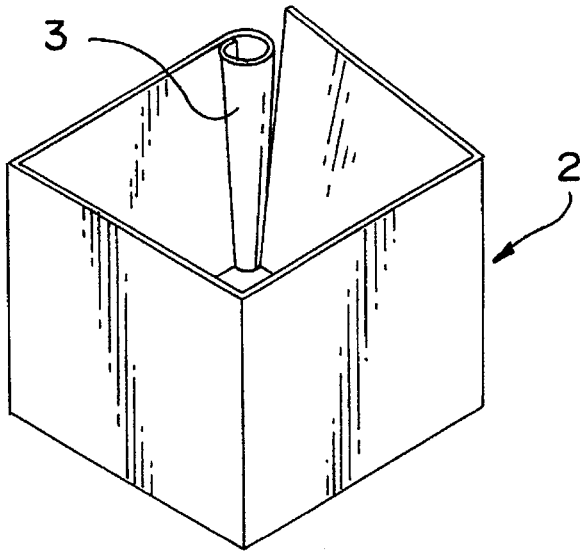
FIG. 2 is a perspective view of a disposable ash pocket having an integral extinguisher which is to be used with the ash tray shown in FIG. 1.

Referring to FIG. 2, there is shown the disposable ash pocket 2. As shown in the drawing, the disposable ash pocket 2 is formed at a corner with the extinguishing means. The extinguishing means comprises a conical extinguisher 3 which is formed by curling a portion of the sheet extended from the corner of the ash pocket 2. The extinguisher 3 has an upper diameter larger than a lower diameter.

In this embodiment, the disposable ash pocket 2 is prepared in such a manner that a vertical edge of the sheet forming the ash pocket is curled inward to form the extinguisher 3 and the other vertical edge is attached to the extinguisher 3.

Figure 3A:
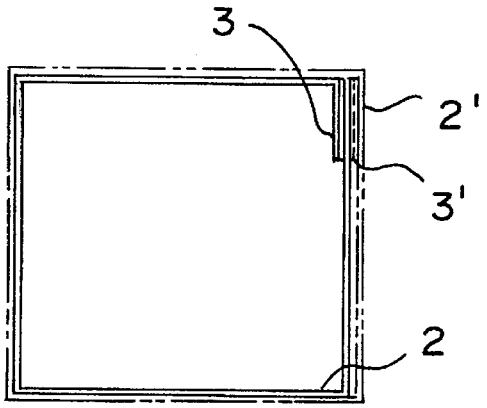
FIG. 3A is a plan view of the disposable ash pocket shown in FIG. 2, in which the extinguisher is folded to be flat.
Figure 3B:
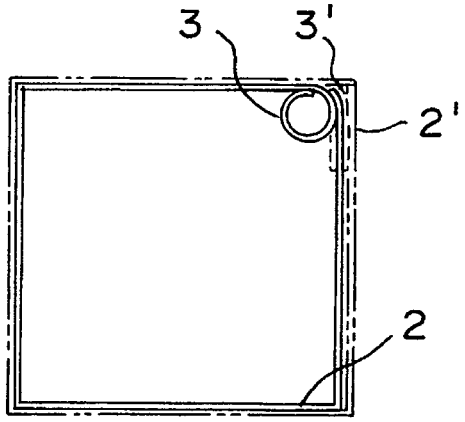
FIG. 3B is a view similar to FIG. 3A, in which the extinguisher is expanded.

Referring to FIGS. 3A and 3B, there are shown a plurality of stacked disposable ash pockets 2 illustrating usage thereof. When the plurality of disposable ash pockets 2 are stacked one another, the extinguisher 3 is folded to be flat, as shown in FIG. 3A. When the smoker uses the disposable ash pockets 2, the folded extinguisher 3 of the innermost ash pocket 2 is expanded into a conical shape by means of appropriate means.

When the innermost ash pocket 2 is filled with cigarette ashes and cigarette-butts, the innermost ash pocket 2 containing the ashes and cigarette-butts is taken out of the ash box 1 and then discarded. After the innermost ash pocket is taken out, the next innermost ash pocket 2' is automatically prepared with the folded extinguisher 3' and then the folded extinguisher 3' is also expanded into a conical shape.

In this embodiment, since the folded extinguisher 3 or 3' is disposed at a corner of the ash pocket 2, the extinguisher 3 may be bulged inward if the plurality of ash pockets 2, 2' are stacked in the same orientation. For overcoming the bulging problem, the plurality of ash pockets 2, 2' are stacked one another in such a manner that the adjacent extinguisher 3, 3' are disposed at interval of the right angle in one direction.

Figure 4:
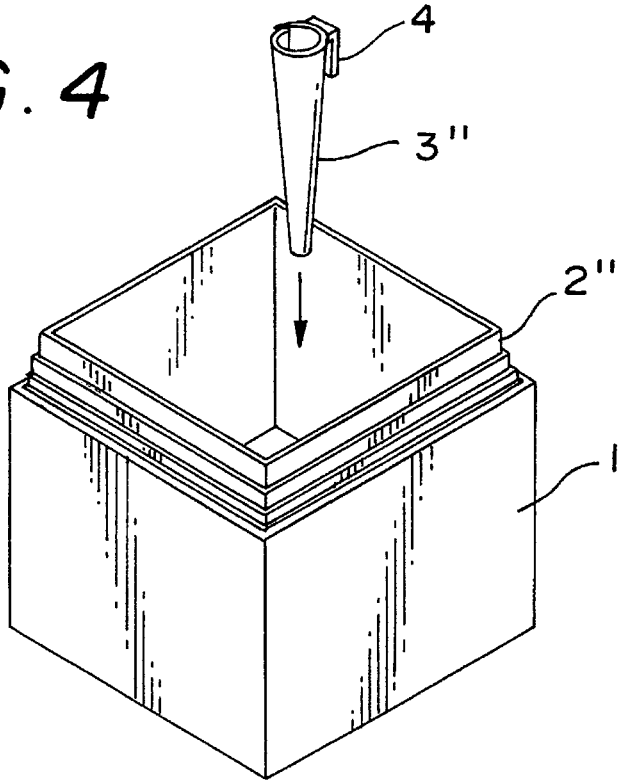
FIG. 4 is a perspective view of an ash tray according to another embodiment of the invention.

Referring to FIG. 4, there is shown an ash pocket according to another embodiment of the invention. As shown in the drawing, the ash pocket 2" is a simple hexahedron opening upward and a plurality of ash pockets 2" are stacked one another. The stacked ash pockets 2" are provided therein with a separable extinguisher 3" having a clip 4. Therefore, the separable extinguisher 3" can be mounted on the ash pockets 2" by means of its clip 4. The ash pocket 2 equipped with the separable extinguisher 3" according to this embodiment has the same effect as that of the previous embodiment.

As apparent from the above description, since the ash tray of the invention includes a plurality of stacked disposable ash pockets and an extinguisher integrally formed with or detachably attached to the ash pockets, the innermost ash pocket can be taken out of the next ash pocket to be discarded and the next fresh ash pocket can be prepared automatically after the innermost ash pocket is filled with ashes and cigarette-butts. Therefore, the ash tray of the invention can eliminate a troublesome job of replacement and cleaning of a used ash tray.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An ash tray, comprising:

a) a plurality of disposable ash pockets, each of said ash pockets being stacked one in another such that one of said ash pockets is innermost and topmost ready to receive the ash from a lighted cigarette and the next below ash pocket becomes ready for use when the topmost ash pocket is disposed after use, each of said ash pockets including vertical walls; and b) each of said ash pockets including a flexible vertical flat sheet releasably secured to a portion of one of said vertical walls, said flat sheet being disposed within the volume of the respective ash pocket; and c) said sheet being adapted to be formed into a conical hollow member so as to be secured in said ash pocket to receive and snuff out the lighted end of a cigarette.

2. An ash tray as in claim 1, wherein:

a) each of said conical hollow member when formed is disposed at one corner of the respective ash pocket.

3. An ash tray as in claim 1, wherein:

a) each of said ash pockets are stacked such that each of said vertical flat sheet is staggered 90° relative to the vertical flat sheet of the immediately adjacent ash pocket.

4. An ashtray as in claim 1, and further comprising:

a) an ash box adapted to receive and support said ash pockets.

5. An ashtray as in claim 1, wherein:

a) said flat sheet includes a vertical edge; and b) said vertical edge is curled inwardly when said conical hollow member is formed.

* * * * *